US006649580B2

(12) United States Patent
Aszman et al.

(10) Patent No.: US 6,649,580 B2
(45) Date of Patent: Nov. 18, 2003

(54) CLEANING COMPOSITIONS

(75) Inventors: Harry Aszman, Englishtown, NJ (US); Alison Kugler, Morganville, NJ (US)

(73) Assignee: Colgate-Palmolive Company, New York, NY (US)

( * ) Notice: Subject to any disclaimer, the term of this patent is extended or adjusted under 35 U.S.C. 154(b) by 100 days.

(21) Appl. No.: 10/008,135

(22) Filed: Nov. 7, 2001

(65) Prior Publication Data

US 2002/0039979 A1 Apr. 4, 2002

Related U.S. Application Data

(63) Continuation-in-part of application No. 09/854,745, filed on May 14, 2001, now abandoned, which is a continuation-in-part of application No. 09/553,186, filed on Apr. 20, 2000, now abandoned.

(51) Int. Cl.[7] ..... C11D 1/90; C11D 3/48

(52) U.S. Cl. ..... 510/180; 510/181; 510/182; 510/382; 510/384; 510/391; 510/432; 510/433

(58) Field of Search ..... 510/180, 181, 510/182, 382, 384, 391, 433, 432

(56) References Cited

U.S. PATENT DOCUMENTS 5,454,983 A * 10/1995 Michael et al. ..... 252/545

* cited by examiner

*Primary Examiner*—Charles Boyer
(74) *Attorney, Agent, or Firm*—Richard E. Nanfeldt

(57) ABSTRACT

The present invention relates to a toilet bowl or glass cleaning composition containing a surfactant, a disinfecting agent, a polymeric viscosity modifier and water.

5 Claims, No Drawings

CLEANING COMPOSITIONS

RELATED APPLICATION

This application is a continuation in part application of U.S. Ser. No. 09/854,745 filed May 14, 2001 now abandoned, which in turn is a continuation in part of U.S. Ser. No. 09/553,186 filed Apr. 20, 2000 now abandoned.

FIELD OF THE INVENTION

The present invention relates to a toilet bowl cleaner which contains a nonionic surfactant, a disinfecting agent, a polymeric viscosity modifier and water as well as a glass cleaning composition containing a polymeric viscosity modifier.

BACKGROUND OF THE INVENTION

Numerous compositions and apparatus have been previously disclosed for cleaning toilet bowls. These compositions are designed to impede irritable smells and bacteria build up.

U.S. Pat. No. 4,852,201 teaches a cleaning composition containing a surfactant, alkali metal carbonate and acid.

U.S. Pat. No. 5,977,050 teaches a sprayable toilet bowl cleaning composition which is in a gel form which comprises a surfactant, crosslinked polyacrylic acid, a glycol ether solvent and water.

U.S. Pat. No. 5,534,265 relates to a personal cleaning composition which can contain a Polyquaternium 37 type polymer and water insoluble particles.

SUMMARY OF THE INVENTION

The instant invention relates to a toilet bowl cleaning composition which contains an ethoxylated nonionic surfactant, a disinfecting agent, a polymeric thickening agent and water as well as a glass cleaning composition containing a polymeric viscosity modifier.

An object of the instant invention is to provide a thickened glass cleaner which permits easy cleaning of the vertical surfaces of the toilet bowl.

A further object of the instant invention is to provide a glass cleaner which is effective in killing germs.

A still further objection of the instant invention is to provide a glass cleaner which is sprayable.

DETAILED DESCRIPTION OF THE INVENTION

The present invention relates to a liquid toilet bowl cleaning composition which comprises approximately by weight:

(a) 0.1% to 8%, more preferably 1% to 6% of a nonionic surfactant;

(b) 0.05% to 2.5%, more preferably 0.1% to 1.5% of a disinfecting agent;

(c) 0 to 2%, more preferably 0.1% to 1% of a perfume;

(d) 0.1% to 2.5%, more preferably 0.2% to 1.5% of a polymeric viscosity modifier; and (e) the balance being water, wherein the toilet bowl composition does not contain an anionic surfactant, a cationic surfactant, an ethylene glycol ether, a propylene glycol ether, a fluorosurfactant, a thickener such as silica, methyl cellulose, clay, xanthan gum, polysaccharide or magnesium aluminum silicate, a polyglucoside or glucoside surfactant, sodium hydroxide, a halogen donating compound such as halohydantions such as 1,3-dichloro-5,5-dimethyl hydantoin, 1,3-dichloro-5-ethyl-5methyl hydatoin and 1-bromo-3-3-chloro-5,5-dimethyl hydatoin and calcium hypochlorite, an abrasive, a suspending agent such as a hydrophilic silica, calcium carbonate, sodium bicarbonate, aluminum oxide, alignates, guar gum, cellulosis, or a propellant such as a hydrocarbon having 1 to 10 carbon atoms such as propane or isobutane.

The present invention also relates to a liquid glass cleaning composition which comprises approximately by weight:

(a) 0.1% to 6%, more preferably 0.25% to 5% of a zwitterionic surfactant;

(b) 0 to 4%, more preferably 0.1% to 4% of a disinfecting agent;

(c) 0 to 2%, more preferably 0.05% to 1% of a perfume;

(d) 0.1% to 2.5%, more preferably 0.2% to 1.5% of a polymeric viscosity modifier;

(e) 0.25% to 8%, more preferably 0.5% to 6% of a $C_2$–$C_3$ alkanol such as ethanol, n-propanol or isopropanol; and (f) the balance being water, wherein the glass cleaning composition does not contain an anionic surfactant, a cationic surfactant, an ethylene glycol ether, a propylene glycol ether, a fluorosurfactant, a thickener such as silica, methyl cellulose, clay, xanthan gum, polysaccharide or magnesium aluminum silicate, a polyglucoside or glucoside surfactant, sodium hydroxide, a halogen donating compound such as halohydantions such as 1,3-dichloro-5,5-dimethyl hydantoin, 1,3-dichloro-5-ethyl-5methyl hydatoin and 1-bromo-3-3-chloro-5,5-dimethyl hydatoin and calcium hypochlorite, an abrasive, a suspending agent such as a hydrophilic silica, calcium carbonate, sodium bicarbonate, aluminum oxide, alignates, guar gum, cellulosis, or a propellant such as a hydrocarbon having 1 to 10 carbon atoms such as propane or isobutane. Also excluded from the instant liquid glass cleaning composition insoluble particles selected from the group consisting of polybutylene, polyethene, polyisobutylene, polymethylstyrene, polypropylene, polystyrene, polyurethane, nylon, teflon, and mixtures thereof having a mean particle size diameter from about 20 microns to about 50 microns.

The water soluble nonionic surfactants utilized in the toilet bowl cleaning composition of this invention are commercially well known and include the primary aliphatic alcohol ethoxylates, secondary aliphatic alcohol ethoxylates, alkylphenol ethoxylates and ethylene-oxide-propylene oxide condensates on primary alkanols, such a Plurafacs (BASF) and condensates of ethylene oxide with sorbitan fatty acid esters such as the Tweens (ICI). The nonionic synthetic organic detergents generally are the condensation products of an organic aliphatic or alkyl aromatic hydrophobic compound and hydrophilic ethylene oxide groups. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic detergent.

The nonionic detergent class includes the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole of myristyl alcohol, the condensation product of EO with a cut of coconut fatty alcohol containing a mixture of fatty alcohols with alkyl chains varying from 10 to about 14 carbon atoms in length and wherein the condensate contains either about 6 moles of EO per mole of total alcohol or about 9 moles of EO per mole of alcohol and tallow alcohol ethoxylates containing 6 EO to 11 EO per mole of alcohol.

A preferred group of the foregoing nonionic surfactants are the Neodol ethoxylates (Shell Co.), which are higher aliphatic, primary alcohol containing about 9–15 carbon atoms, such as $C_9$–$C_{11}$ alkanol condensed with 8 moles of ethylene oxide (Neodol 91-8), $C_{12-13}$ alkanol condensed with 6.5 moles ethylene oxide (Neodol 23-6.5), $C_{12-15}$ alkanol condensed with 12 moles ethylene oxide (Neodol 25-12), $C_{14-15}$ alkanol condensed with 13 moles ethylene oxide (Neodol 45-13), and the like. Such ethoxamers have an HLB (hydrophobic lipophilic balance) value of about 8 to 15 and give good O/W emulsification, whereas ethoxamers with HLB values below 8 contain less than 5 ethyleneoxide groups and tend to be poor emulsifiers and poor detergents.

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol 15-S-9) or 12 EO (Tergitol 15-S-12) marketed by Union Carbide.

Other suitable nonionic detergents include the polyethylene oxide condensates of one mole of alkyl phenol containing from about 8 to 18 carbon atoms in a straight- or branched chain alkyl group with about 5 to 30 moles of ethylene oxide. Specific examples of alkyl phenol ethoxylates include nonyl phenol condensed with about 9.5 moles of EO per mole of nonyl phenol, dinonyl phenol condensed with about 12 moles of EO per mole of dinonyl phenol, dinonyl phenol condensed with about 15 moles of EO per mole of phenol and di-isoctylphenol condensed with about 15 moles of EO per mole of phenol. Commercially available nonionic surfactants of this type include Igepal CO-630 (nonyl phenol ethoxylate) marketed by GAF Corporation.

Condensates of 2 to 30 moles of ethylene oxide with sorbitan mono- and tri-$C_{10}$–$C_{20}$ alkanoic acid esters having a HLB of 8 to 15 also may be employed as the nonionic detergent ingredient in the described shampoo. These surfactants are well known and are available from Imperial Chemical Industries under the Tween trade name. Suitable surfactants include polyoxyethylene (4) sorbitan monolaurate, polyoxyethylene (4) sorbitan monostearate, polyoxyethylene (20) sorbitan trioleate and polyoxyethylene (20) sorbitan tristearate.

The instant glass cleaning or toilet bowl cleaning compositions contain a disinfectant agent selected from the group consisting of $C_8$–$C_{16}$ alkyl amines, $C_8$–$C_{16}$ alkyl benzyl dimethyl ammonium chlorides, $C_8$–$C_{16}$ dialkyl dimethyl ammonium chlorides, $C_8$–$C_{16}$ alkyl, $C_8$–$C_{14}$ alkyl dimethyl ammonium chloride, benzalkonium chloride, and chlorohexidine and mixtures thereof. Some typical disinfectant agent useful in the instant compositions are manufactured by Lonza, S. A. They are: Bardac 2180 (or 2170) which is N-decyl-N-isonoxyl-N,N-dimethyl ammonium chloride; Bardac 22 which is didecyl dimethyl ammonium chloride; Bardac LF which is N,Ndioctyl-N,N-dimethyl ammonium chloride; Bardac 114 which is a mixture in a ratio of 1:1:1 of N-alkyl-N,N-didecyl-N,N-dimethyl ammonium chloride/N-alkyl-N,N-dimethyl-N-ethyl ammonium chloride; and Barquat MB-50 which is N-alkyl-N,N-dimethyl-N-benzyl ammonium chloride. The preferred disinfecting agent is a $C_8$–$C_{16}$ alkyl benzyl dimethyl ammonium chloride.

The instant liquid glass cleaning composition contain a water-soluble zwitterionic surfactant which is a water soluble betaine having the general formula:

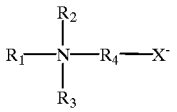

wherein $X^-$ is selected from the group consisting of $CO_2^-$ and $SO_3^-$ and $R_1$ is an alkyl group having 10 to about 20 carbon atoms, preferably 12 to 16 carbon atoms, or the amido radical:

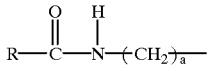

wherein R is an alkyl group having about 9 to 19 carbon atoms and a is the integer 1 to 4; $R_2$ and $R_3$ are each alkyl groups having 1 to 3 carbons and preferably 1 carbon; $R_4$ is an alkylene or hydroxyalkylene group having from 1 to 4 carbon atoms and, optionally, one hydroxyl group. Typical alkyldimethyl betaines include decyl dimethyl betaine or 2-(N-decyl-N,N-dimethyl-ammonia) acetate, coco dimethyl betaine or 2-(N-coco N,N-dimethylammonia) acetate, myristyl dimethyl betaine, palmityl dimethyl betaine, lauryl dimethyl betaine, cetyl dimethyl betaine, stearyl dimethyl betaine, etc. The amidobetaines similarly include cocoamidoethylbetaine, cocoamidopropyl betaine and the like. A preferred betaine is coco ($C_8$–$C_{18}$) amidopropyl dimethyl betaine. Two preferred betaine surfactants are Rewoteric AMB 14U and Goldschmidt Betaine L7.

The instant glass cleaning or toilet bowl cleaning composition contains about 0.1 to 2.5 wt. %, more preferably 0.2 to 1.5% of a polymeric viscosity modifier which permits the toilet bowl cleaning composition to have a Brookfield viscosity RVDV, 25° C., cps about 150 to 400 cps, more preferably 175 to 250 cps. The polymeric viscosity modifier agent is a noncrosslinked quaternary acrylic acid homopolymer having a molecular weight of about 30,000 to about 2,000,000 such as Polygel K200 manufactured by 3V Inc. of Georgetown, S.C. Polygel K-200 is N,N,N-Trimethyl-2 [Methyl-1-Oxo-Propenyl]oxy-chloride homopolymer.

As used herein the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance odoriferous substances. Typically, perfumes are complex mixtures of blends of various organic compounds such as alcohols, aldehydes, ethers, aromatic compounds and varying amounts of essential oils (e.g., terpenes) such as from 0 to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc. The instant compositions show a marked improvement in ecotoxocity as compared to existing commercial products.

The final essential ingredient in the inventive toilet bowl or glass cleaning compositions is water. The proportion of water in the toilet bowl cleaning composition compositions generally is in the range of 20% to 97%, preferably 70% to 97% by weight.

The liquid toilet bowl or glass cleaning compositions of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as EDTA, formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed.

The toilet bowl or glass cleaning composition can optionally including at a concentration of 0 to 2.5 wt. %, more preferably 0.1 to 1.5 wt. % a proton donating agent selected from the group consisting of nonhydroxy containing organic acids such as succinic acid, glutaric acid, adipic acid, hydroxy containing organic acids such as ortho hydroxy benzoic acid, citric acid and lactic acid and inorganic acids such as sulfuric acid, hydrochloric acid and phosphoric acid and mixtures thereof.

In final form, the compositions exhibit stability at reduced and increased temperatures. More specifically, such compositions remain clear and stable in the range of 4° C. to 50° C., especially 2° C. to 43° C. Such compositions exhibit a pH in the acid to neutral range.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable.

Addition of Polygel K200 requires special procedures to assure complete and timely hydration. As soon as Polygel K200 contacts an aqueous medium, it begins to hydrate. Large particles of Polygel K200 results in large lumps once in contact with aqueous medium and swell. The Polygel K200 should be added to non-aqueous medium to assure good dispersion, smallest particles size, before adding to aqueous medium to minimize lumps and have timely batch times. An acceptable practice is to add Polygel K200 to the fragrance and or nonionic surfactant with minimal mixing before adding to the aqueous medium. It is not necessary to use elevated temperatures in the formation step and room temperature is sufficient.

The instant compositions formulas explicitly exclude alkali metal sulfates, alkali metal silicates and alkali metal builders such as alkali metal polyphosphates, alkali aqueous medium and swell. The Polygel K200 should be added to non-aqueous medium to assure good dispersion, smallest particles size, before adding to aqueous medium to minimize lumps and have timely batch times. An acceptable practice is to add Polygel K200 to the fragrance and or nonionic surfactant with minimal mixing before adding to the aqueous medium. It is not necessary to use elevated temperatures in the formation step and room temperature is sufficient.

The instant compositions formulas explicitly exclude alkali metal sulfates, alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid grass or toilet bowl cleaning compositions of the described invention. Unless otherwise specified, all percentages are by weight. The exemplified compositions are illustrative only and do not limit the scope of the invention.

EXAMPLE 1

The following toilet bowl cleaning formula in wt. % was made by simple mixing at 25° C.

| | A |
|---|---|
| $C_{12}$–$C_{15}$ ethoxylated nonionic EO9:1 | 3.5 |
| Polygel K200 | 0.9 |
| Alkyl dimethyl benzyl ammonium chloride | 0.5 |
| Perfume | 0.4 |
| EDTA-tetrasodium salt | 0.12 |
| Formaldehyde | 0.075 |
| Water | Bal. |
| Brookfield viscosity, 25C #21 spindle 10 rpm | 200 cps |
| pH | 7.0 |

What is claimed:

1. A glass cleaning composition which comprises approximately by weight:

(a) 0.1% to 6% of a zwitterionic surfactant;

(b) 0.1% to 4% of a disinfecting agent;

(c) 0.25% to 8% of a $C_2$–$C_3$ alkanol;

(d) 0.1% to 2.5% of a polymeric viscosity modifier; and (e) the balance being water, wherein the composition does not contain a cationic surfactant.

2. The composition according to claim 1, wherein said polymeric viscosity modifier is a polyacrylic acid homopolymer.

3. The composition of claim 2, wherein said disinfecting agent is selected from the group consisting of $C_8$–$C_{16}$ alkyl amines, and chlorohexidine and mixtures thereof.

4. The composition of claim 1, further including a preservative.

5. The composition of claim 1, further including a proton donating agent.

* * * * *